US006216654B1

(12) United States Patent
Regueiro

(10) Patent No.: US 6,216,654 B1
(45) Date of Patent: Apr. 17, 2001

(54) PHASE CHANGING DEVICE

(75) Inventor: Jose F. Regueiro, Rochester Hills, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/384,680

(22) Filed: Aug. 27, 1999

(51) Int. Cl.[7] ..... F01L 1/34

(52) U.S. Cl. ..... 123/90.15; 123/90.17; 123/90.18

(58) Field of Search ..... 123/90.15, 90.17, 123/90.18, 90.31, 90.34, 193.5

(56) References Cited

U.S. PATENT DOCUMENTS

| | | | | |
|---|---|---|---|---|
| 4,438,737 | * | 3/1984 | Burandt | 123/90.17 |
| 4,463,712 | | 8/1984 | Stojek et al. . | |
| 4,561,390 | | 12/1985 | Nakamura et al. . | |
| 4,771,742 | * | 9/1988 | Nelson et al. | 123/90.17 |
| 4,986,801 | | 1/1991 | Ohlendorf et al. . | |
| 5,090,366 | * | 2/1992 | Gondek | 123/90.17 |
| 5,111,780 | | 5/1992 | Hannibal . | |
| 5,119,691 | * | 6/1992 | Lichti et al. | 123/90.17 |
| 5,125,372 | * | 6/1992 | Gondek | 123/90.17 |
| 5,163,872 | * | 11/1992 | Niemiec et al. | 123/90.31 |
| 5,253,622 | * | 10/1993 | Bornstein et al. | 123/90.17 |
| 5,355,849 | | 10/1994 | Schiattino . | |
| 5,417,186 | * | 5/1995 | Elrod et al. | 123/90.17 |
| 5,542,383 | | 8/1996 | Clarke et al. . | |
| 5,588,404 | * | 12/1996 | Lichti et al. | 123/90.17 |
| 5,592,909 | * | 1/1997 | Tsuruta | 123/90.17 |
| 5,673,659 | | 10/1997 | Regueiro . | |
| 5,680,837 | | 10/1997 | Pierik . | |
| 5,687,681 | | 11/1997 | Hara . | |
| 5,803,030 | * | 9/1998 | Cole | 123/90.17 |
| 5,860,328 | * | 1/1999 | Regueiro | 123/90.17 |

* cited by examiner

*Primary Examiner*—Teresa Walberg
*Assistant Examiner*—Fadi H. Dahbour
(74) *Attorney, Agent, or Firm*—Kenneth H. Maclean

(57) ABSTRACT

A new and improved two-part phase changing device which has an axially movable quill shaft extending through a hollow camshaft and has one end of the quill shaft directly connected to the hub member of the timing gear through straight splines and has the other end of the quill shaft connected by helical splines to the camshaft so that axial movement of the quill shaft provided by a ball nut transmission located adjacent the helical splines of the quill shaft serves to angularly reposition the camshaft a predetermined distance upon actuation of an electric stepper motor.

14 Claims, 2 Drawing Sheets

PHASE CHANGING DEVICE

FIELD OF INVENTION

This invention relates to a valve train of an internal combustion engine and, more particularly, concerns a device for varying the timing of the opening and closing of the intake and/or exhaust valves with respect to the phase of the piston stroke.

BACKGROUND OF THE INVENTION

My U.S. Pat. No. 5,673,659 entitled "Lead Screw Driven Shaft Phase Control Mechanism", issued on Oct. 7, 1997 and assigned to the assignee of this invention, discloses a mechanism that provides a selective timing or phase adjusting system between a drive gear and a driven camshaft with the drive gear being coaxially mounted and axially affixed with respect to the driven camshaft for rotation together. An intermediate connecting member is coaxially mounted with respect to the drive gear and the camshaft and is capable of axial movement and angular movement with respect to either the camshaft or the drive gear when experiencing its relative axial movement. The intermediate connection and a coupling member are connected to a geared device that is selectively activated by an electric motor which produces axial movement of both the intermediate connection and the coupling member with respect to the camshaft and the drive gear to any desired axial position between predetermined first and second positions. The gearing device provides a unidirectional drive system which allows the electric control motor to drive the mechanism to provide the optimum shaft phasing and is operably connected to a sleeve that is axially affixed to the intermediate connecting member. When in operation, the gearing device moves the sleeve axially, which in turn, moves the intermediate member axially with respect to both the drive gear and the camshaft. The intermediate connection member is an axially shifting member that has helical splines that rotationally affix it to the camshaft to allow relative rotation of the camshaft with respect to the drive gear. In one embodiment, the gearing device drives the sleeve while in another embodiment the gearing device is a threaded lead screw engaging complementary threads formed on the sleeve. In a third embodiment disclosed in the patent, the gearing device is a part of a gear sprocket that has an internally threaded hub that engages complementary external threads on the sleeve.

In my U.S. Pat. No. 5,860,328 entitled "SHAFT PHASE CONTROL MECHANISM WITH AN AXIALLY SHIFTABLE SPLINED MEMBER", which issued Jan. 19, 1999 and assigned to the assignee of this invention, I disclose a two part variable valve timing system. In my co-pending patent application, Ser. No. 09/283,019, entitled "TWO PART VARIABLE VALVE TIMING MECHANISM", filed on Apr. 1, 1999 and assigned to the assignee of this invention, I disclose a new form of power transmission that is substituted for the threaded jackscrew system which executes the axial motion of the shifting sleeve. Inasmuch as the lowest possible friction level is desired in phase changing devices to minimize wear and to allow use of a small electric motor for varying the position of the camshaft, it is important to have a transmission arrangement with less friction than an ACME screw. As stated in the aforementioned patent application, the optimum replacement for an ACME screw would be the ball-nut recirculating screw device which enjoys very low friction in operation. However, irrespective of the many advantages provided by such a device, using it for phase changing device is not possible from a practical standpoint because the required ball-return duct would interfere with the drive gear. Accordingly, in the mechanism covered by the above patent application, I have incorporated into the phase changing device one of the ball-nut transmissions disclosed in my co-pending patent application, Ser. No. 09/271,229, entitled "BALL-NUT TRANSMISSION", filed on Mar. 17, 1999, and assigned to the assignee of this invention.

SUMMARY OF THE INVENTION

The present invention has certain similarities to the mechanism shown in my patent application, Ser. No. 09/283,019, entitled "TWO PART VARIABLE VALVE TIMING MECHANISM", filed on Apr. 1, 1999, but differs therefrom in that the splined connection between the camshaft and the quill shaft, rather than being grouped together at one end or the other of the mechanism are, instead, separated so that the helical spline connection is incorporated with the control assembly and the straight spline connection is incorporated with the timing drive assembly. The advantage of so doing is to simplify the construction of the rear control assembly of the phase changing device. In addition, the power transmission includes one form of the ball-nut transmission disclosed in my above-mentioned co-pending patent application.

One object of the present invention is to provide a new and improved phase changing device that is provided with two major parts one of which is located at the front end of an internal combustion engine and the other is located at the rear end of the engine and in which the control section of the mechanism incorporates a ball-nut transmission for providing linear movement of a quill shaft interacting with straight splines incorporated with the timing drive assembly and helical splines incorporated with control section for changing the phase of a camshaft.

Another object of the present invention is to provide a new and improved phase changing device which has an axially movable quill shaft extending through a hollow camshaft and has one end of the quill shaft directly connected to the camshaft through helical splines and has the other end of the quill shaft connected by straight splines to the timing gear so that axial movement of the quill shaft provided by a ball nut transmission located at the other end of the quill shaft serves to rotate the camshaft a predetermined distance upon actuation of an electric stepper motor.

A further object of the present invention is to provide a new and improved phase changing device incorporating a non-recirculating ball-nut transmission for linearly moving a quill shaft and in which balls are encapsulated in hemispherical cavities formed in an axially movable sleeve surrounded by a nut member having a helical groove which cooperates with the balls for providing axial movement of the quill shaft and operates through helical splines at one end of the quill shaft to reposition the camshaft relative to the drive gear which forms a part of the timing gear assembly.

The above objects and others are realized in accordance with the invention by a phase changing device for an internal combustion engine that comprises a timing drive assembly located at one end of the engine and a control assembly located at the other end of the engine. The timing drive assembly has a drive gear adapted to be driven by the crankshaft of the engine and a hollow camshaft extends between the timing drive assembly and the control assembly. A quill shaft is co-axially mounted within the hollow camshaft and has a first portion located at the other end and is connected to the hollow camshaft by a plurality of helical splines surrounding the first portion of the quill shaft. A hub member is fixed with the drive gear and a second portion of the quill shaft is located at the above-mentioned one end of the engine and is connected to the hub member by a plurality of straight splines. An axially movable sleeve member is connected to and surrounds the first portion of the quill shaft located at the other end. A nut member surrounds the sleeve member and is drivingly connected to the sleeve member through a plurality of circumferentially spaced non-recirculating balls encapsulated in one of the members and located in a helical groove formed in the other of the members so that, upon rotation of the nut member, the sleeve member and the quill shaft move axially relative to the camshaft and simultaneously through the helical splines and the straight splines cause the camshaft to change its angular position with respect to the drive gear.

BRIEF DESCRIPTION OF THE DRAWINGS

Other objects and advantages of the present invention will be more apparent from the following detailed description of the invention when taken with the drawings in which.

DETAILED DESCRIPTION OF THE INVENTION

Figure 1:
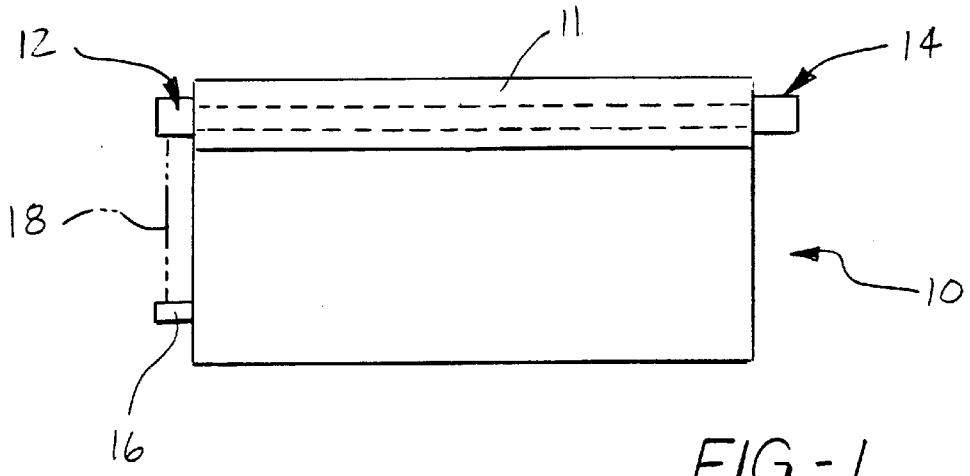
FIG. 1 is a schematic representation of the phase changing device according to the present invention combined with an internal combustion engine with the timing drive assembly of the mechanism located at the front end of the engine and connected to the crankshaft of the engine and with the control assembly located at the rear of the engine.

Referring to the drawings and more particularly to FIG. 1 thereof, an in-line internal combustion engine 10 is shown schematically in block form as being equipped with a split or divided two-part phase changing device made in accordance with the present invention. The phase changing device shown is intended to be incorporated with the intake camshaft that operates a number of intake valves (not shown) disposed in the cylinder head 11 of the engine 10. It will be understood that a similar phase changing device can control the exhaust camshaft of the engine 10.

Figure 2:
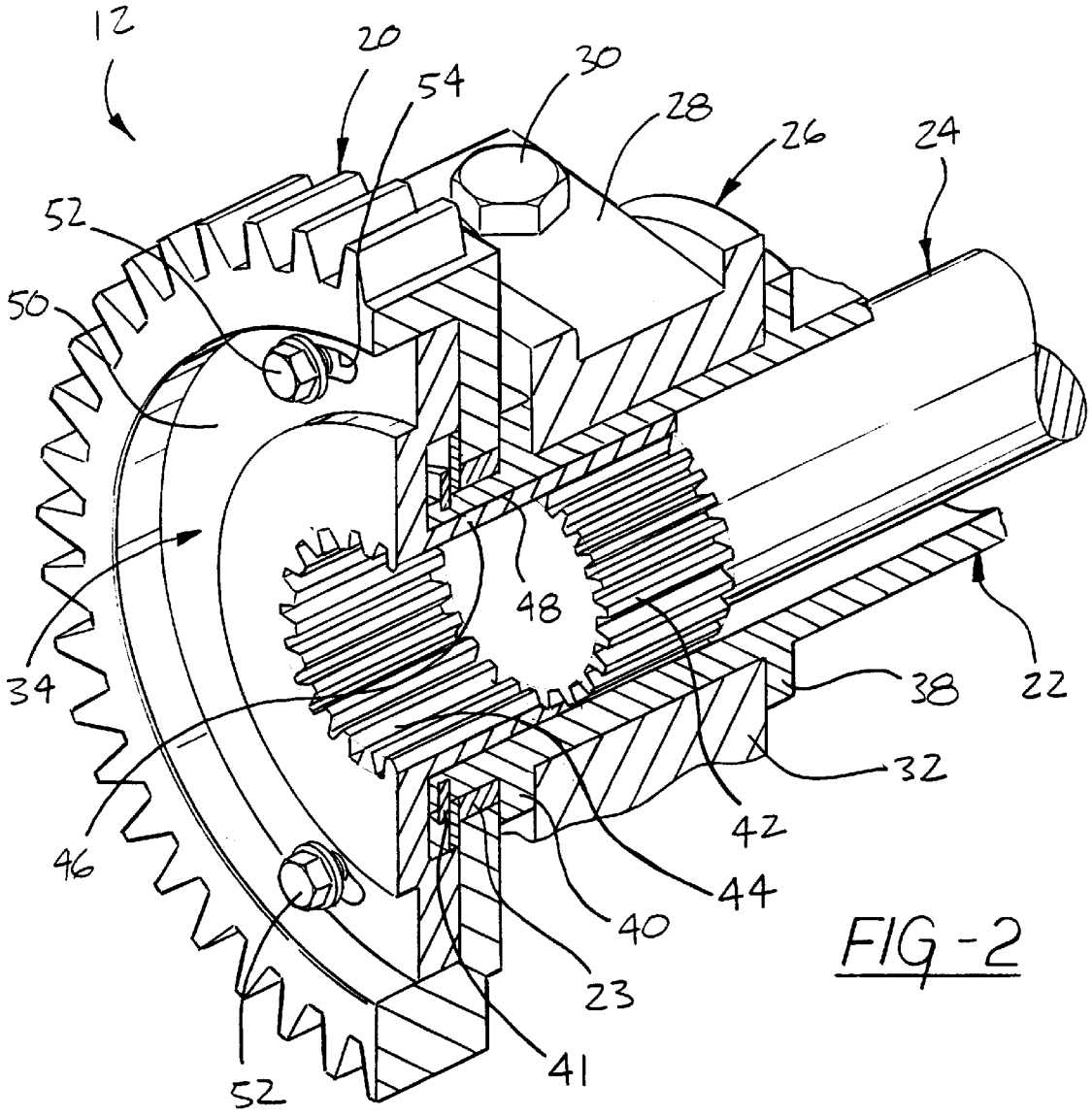
FIG. 2 is an isometric view with parts broken away and some parts in section so as to show the various parts of the timing drive assembly of the phase changing device according to the present invention.
Figure 3:
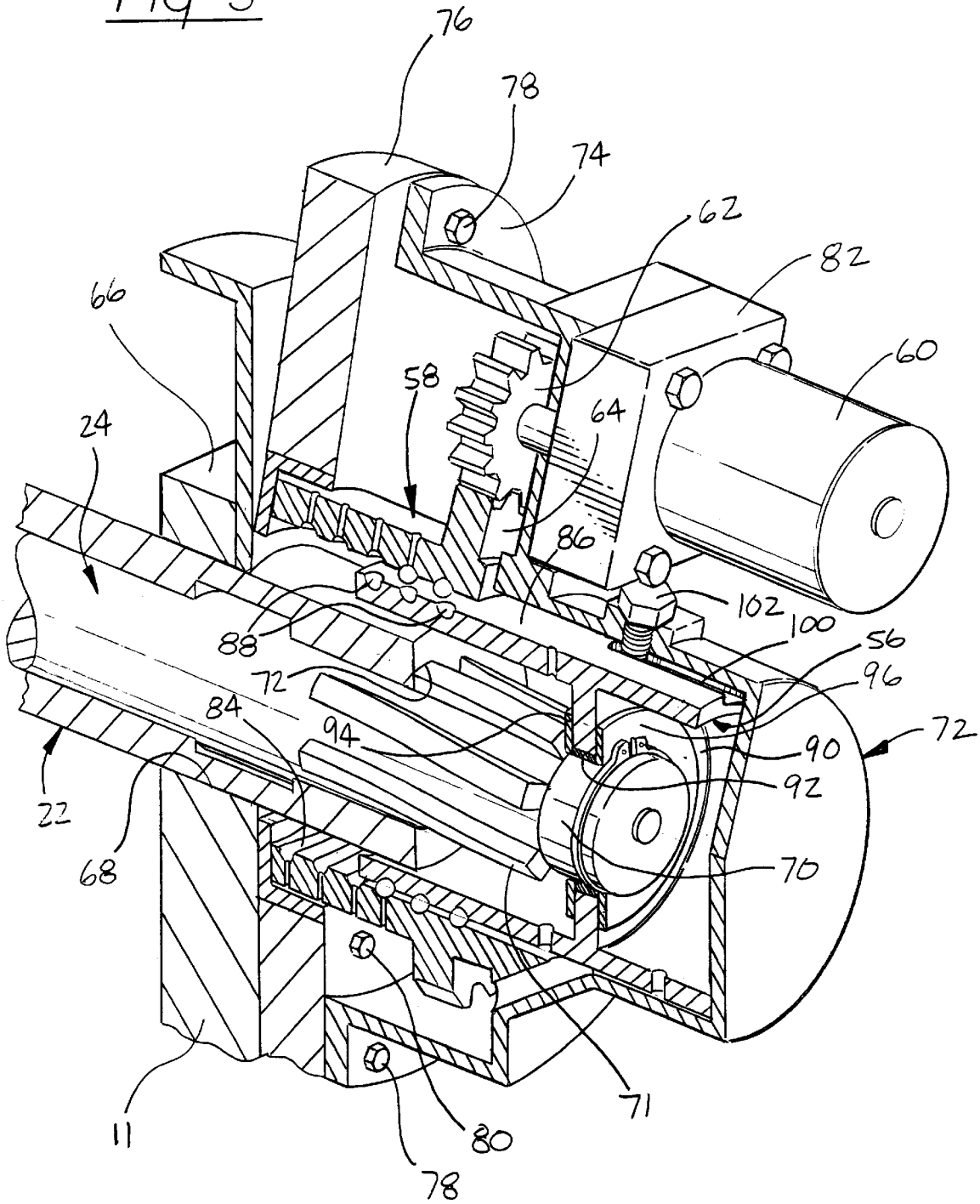
FIG. 3 is an isometric view with parts broken away and some parts sectioned so as to show the various parts of the control assembly that is a part of the phase changing device according to the present invention.

The phase changing device includes a timing drive assembly 12, as shown in FIG. 2, that is mounted at the front end of the engine 10 and a control assembly 14, as seen in FIG. 3, mounted at the rear of the engine 10. One reason for splitting the timing drive assembly 12 from the control assembly 12 is that in transverse engine installations, there is little space at the front timing-end of the engine, but more space at the rear end of the engine over the transaxle. Accordingly, by dividing the phase changing device into two parts, the space available under the hood of an automobile is more efficiently utilized.

The crankshaft 16 of the engine is drivingly connected to the timing drive assembly 12 through a gearing arrangement 18 depicted, in this instance, by the dotted lines extending between the timing drive assembly 12 and the crankshaft 16. Alternatively, rather than having a direct gearing arrangement for providing drive to the timing drive assembly 12, a chain or belt drive can be used for this purpose in which case one sprocket would be connected to the crankshaft 16 and another sprocket would be a part of the timing drive assembly 12. In either case, the drive provided to the timing drive assembly 12 would be a 2:1 speed ratio.

As seen in FIG. 2, the timing drive assembly 12 includes a drive gear 20 which is operatively associated with the front portion of a hollow camshaft 22, the rear portion of which is operatively associated with the control assembly 14 seen in FIG. 3. A bearing sleeve 23 may be interposed between the drive gear 20 and the front portion of the camshaft 22. An elongated and cylindrical quill shaft 24 extends through the hollow camshaft 22 and, in effect, interconnects the timing drive assembly 12 with the control assembly 14. As will become more apparent as the description of the invention proceeds, axial movement of the quill shaft 24 relative to the camshaft 22 serves to change the timing or phase relationship between the camshaft 22 and the crankshaft 16.

More specifically and as seen in FIG. 2, the front portion of the timing drive assembly 12 together with the camshaft 22 is supported for rotation by a bearing assembly 26 which includes a semi-cylindrical bearing cap 28 secured by bolts 30 (only one shown) to a bearing saddle 32 integrally formed as part of the cylinder head 11 of the engine 10. In general, the timing drive assembly 12 comprises the drive gear 20, a hub member 34, and the front portions of the camshaft 22 and the quill shaft 24 all of which are interconnected for rotation about the longitudinal center axis of the camshaft 22. The camshaft 22 is restrained from axial movement by a pair of integrally formed and axially spaced thrust flanges 38 and 40 which abut the opposed sides of the bearing assembly 26 and are annular in configuration. In addition, the drive gear 20 is secured from axial disengagement relative to the camshaft 22 by a thrust bearing-snap ring combination 41 in which the snap ring is located in a groove formed in the front end of the camshaft 22.

The front portion of the quill shaft 24 extends through the camshaft 22 and has its front portion formed with a plurality of circumferentially and equally spaced straight splines 42 which mate with complementary straight splines 44 formed in a rearwardly extending cylindrical section 46 integral with the front end of the hub member 34. The cylindrical section 46 is received within a counter-bore 48 formed in the front end of the camshaft 22. A disk-shaped portion 50 of the hub member 34 is bolted to the drive gear 20 by a plurality of circumferentially spaced bolts, two of which are only shown in FIG. 2 and identified by reference numeral 52. Each of the bolts 52 extends through a curved slot 54 formed in the circular portion 50 of the hub member 34 so as to permit limited angular adjustment of the drive gear 20 relative to the hub member 34 upon loosening of the bolts 52.

The control assembly 14 seen in FIG. 3 is positioned at the rear of the engine 10 as aforementioned and as seen in FIG. 1 and provides the axial movement of the quill shaft 24 for a change in timing or phasing of the camshaft 22 relative to the crankshaft 16. The control assembly 14, in general, comprises the rear portion of the quill shaft 24, the rear portion of the camshaft 22, an axially movable sleeve member 56, a nut member 58, and a stepper motor 60. The stepper motor 60 receives input pulses from an electronic control system (not shown) and is adapted to drivingly rotate the nut member 58 through a pair of gears 62 and 64.

In most engines, the timing or phase relationship between a camshaft and a crankshaft is set and is not adjustable during the operation of the engine. However, various engine related operational conditions or parameters, such as speed, load, temperature, or other operative factors, are functional factors that together relate to an ideal timing or phasing of the camshaft relative to the crankshaft. The parameters or factors are sensed by various devices and inputted as signals to an electronic control unit (ECU) which then produces an appropriate desirable output control signal in the form of control pulses that can afterwards be fed to a stepper motor 60 such as in the control assembly 14 for ideal angular phasing of the camshaft. An ECU for providing such control pulses can be seen in my aforementioned U.S. Pat. No. 5,673,659 and attention is directed to that patent for a full explanation of the manner that the stepper motor 60 of this invention receives the input pulses from an ECU.

As seen in FIG. 3, the rear portion of the camshaft 22 is supported for rotative movement by a bearing cap 66 secured to a bearing saddle 68 integral with the cylinder head 11 of the engine 10. The rear portion of the quill shaft 24 extends through the hollow camshaft 22 and terminates with a reduced diameter portion 70. Forwardly of the reduced diameter portion 70, a plurality of circumferentially and equally spaced helical splines 71 are formed on the rearward portion of the quill shaft 24. The splines 71 mate with complementary helical splines 72 formed on the internal cylindrical surface of the rear portion of the camshaft 22. The rear portion of the quill shaft 24 and the camshaft 22 are located in a housing 73 covering the internal parts of the control assembly 14. The inner flange 74 of the housing 73 is secured to a plate 76 by a plurality of bolts, two of which are only shown in FIG. 3 and each is identified by the reference numeral 78. The plate 76, in turn, is secured to the cylinder head 11 by a plurality of bolts 80 ( one of which is only shown). The electric reversible D.C. stepper motor 60 is adapted to operate through a speed reducing gear set (not shown) located within a gear case 82 fastened to the housing 73 and serving to drive the gear 62 upon energization of the stepper motor 60.

As seen in FIG. 3, the gear 62 meshes with the gear 64 which is integral with the nut member 58 that provides axial movement of the sleeve member 56. In this regard, the nut member 58 is cylindrical in cross section and has its inner cylindrical surface formed with a semi-circular helical groove 84 simulating a screw thread. Similarly, the sleeve member 56 includes a cylindrical section 86 and has a plurality of spherical balls 88 each of which is disposed in an individual hemispherical cavity 89 formed in the outer cylindrical surface of the sleeve member 56. The balls 88 are located along a helical path which matches the helical groove 84 formed in the nut member 58.

The cylindrical section 86 of the sleeve member 56 is integrally formed with a radially inwardly extending flange 90 that is supported by a sleeve bearing 92 and a pair of thrust bearing 94 and 96 located on the reduced portion 70 of the quill shaft 24. The thrust bearings 94 and 96 are held in place by a snap ring 98 located in an annular groove (not shown) formed in the rear end of the quill shaft 24. The outer cylindrical surface of the sleeve member 56 is connected to the housing 73 by a plurality of circumferentially spaced tongue and groove connections one which is only shown consisting of a longitudinally extending groove 100 and a set screw 102. As should be apparent, the lower cylindrical end of the set screw 102 is located in the groove 100 so as to restrict the sleeve member 56 and the quill shaft to axial movement relative to the housing 73 and the camshaft 22.

The phase changing device composed of the timing drive assembly 12 and the control assembly 14 seen in FIGS. 2 and 3 and described above operates as follows:

When the stepper motor 60 receives an input signal and pulses from the ECU calling for a phase change of the camshaft 22, the gear 62 will be drivingly rotated a predetermined amount and in a direction as dictated by the input signal and pulses. The rotation of the gear 62 will cause corresponding rotation of the nut member 58 through the gear 64. As the nut member 58 rotates about the sleeve member 56, the helical groove 84 acts through the encapsulated balls 88 to cause the sleeve member 56, together with the quill shaft 24, to move axially relative to the camshaft 22 as controlled by the tongue and groove connections provided by each of the grooves 100 and cooperating set screws 102. This axial movement causes the helical splines 71 on the quill shaft 24 to move along the complementary helical splines 72 of the camshaft 22 resulting in a rotation of the camshaft 22 relative to the drive gear 16. This occurs due to the fact that the quill shaft 24 is restricted from any rotative movement by the straight splines 42 and 44 and the connection between the drive gear 16 and the hub member 34. Thus, in this manner, a phase change in the operation of the valves of the engine 10 occurs by the repositioning of the camshaft 22 relative to the position of the drive gear 20.

It should be noted that the sleeve member 56 connected to the nut member 58 through the helical groove 84 and the balls 88 constitutes a ball-nut transmission of the type shown in my co-pending patent application, Ser. No. 09/271,229 referred to earlier in this specification. Inasmuch as the balls 88 are located in the hemispherical cavities 89 and encapsulated between the individual cavity supporting each ball 88 and the groove 84 in the nut member 58, this ball-nut transmission provides an efficient linear movement of the sleeve member 56 with a minimum of friction and without the need for a return duct for the balls as found in the conventional ball-nut-screw devices.

Various changes and modifications can be made in the phase changing devices described above without departing from the spirit of the invention. Such changes and modifications are contemplated by the inventor and he does not wish to be limited except by the scope of the appended claims.

What is claimed is:

1. A phase changing device for an internal combustion engine comprising;

a timing drive assembly located at one end of said engine and a control assembly located at the other end of said engine, said timing drive assembly having a drive gear adapted to be driven by the crankshaft of said engine, a hollow camshaft extending between said timing drive assembly and said control assembly, a quill shaft coaxially mounted within said hollow camshaft and having a first portion located at said other end and being connected to said hollow camshaft by a plurality of helical splines integrally formed with said quill shaft and surrounding said first portion of said quill shaft, a hub member fixed with said drive gear, a second portion of said quill shaft located at said one end of said engine and being connected to said hub member by a plurality of straight splines integrally formed with said quill shaft, an axially movable sleeve member connected to and surrounding said first portion of said quill shaft located at said other end of said engine, a nut member surrounding said sleeve member and being drivingly connected to said sleeve member through a plurality of circumferentially spaced non-recirculating balls encapsulated in one of said members and located in a helical groove formed in the other of said members so that, upon rotation of said nut member, said sleeve member and said quill shaft move axially relative to said camshaft and simultaneously through said helical splines cause said camshaft to be angularly repositioned relative to said drive gear, and an electric stepper motor forming a part of said control assembly for rotating said nut member so as to cause the axial movement of said quill shaft and said sleeve member.

2. The phase changing device of claim 1, wherein the outer circumference of said nut member is formed with gear teeth which mesh with the gear teeth of a pinion driven by said stepper motor.

3. The phase changing device of claim 1, wherein said sleeve member is restrained from rotating about its longitudinal center axis by a tongue and groove arrangement located between said sleeve member and the housing of said control assembly.

4. The phase changing device as set forth in claim 1, wherein said drive gear is secured to a hub member having a cylindrical section formed with internal straight splines which mesh with the straight splines of said quill shaft.

5. The phase changing device as set forth in claim 1, wherein said first portion of said quill shaft is supported for limited rotation by a radially inwardly extending flange integrally formed with said sleeve member.

6. The phase changing device as set forth in claim 1, wherein said nut member is formed with said helical groove and said sleeve member has a plurality of spherical balls located in hemispherical cavities spaced along a helical path that matches the helical groove in said nut member.

7. A phase changing device for an internal combustion engine comprising;

a timing drive assembly located at one end of said engine and a control assembly located at the other end of said engine, said timing drive assembly having a drive gear adapted to be driven by the crankshaft of said engine;

a hollow camshaft extending between said timing drive assembly and said control assembly;

a quill shaft coaxially mounted within said hollow camshaft and having a first portion located at said other end formed with helical splines mating with internal helical splines formed in said hollow camshaft;

a hub member fixed with said drive gear, said quill shaft having a second portion at said one end and being connected to said hub member by a plurality of straight splines;

an axially movable sleeve member connected to and surrounding said first portion of said quill shaft located at said other end, and a nut member surrounding said sleeve member and being drivingly connected to said sleeve member through a plurality of circumferentially spaced non-recirculating balls each of which is encapsulated between a hemispherical cavity and said helical groove formed in the other of said members so that, upon rotation of said nut member, said sleeve member and said quill shaft move axially relative to said camshaft and simultaneously through said helical splines formed on said quill shaft and in said hollow camshaft cause said camshaft to be angularly repositioned relative to said drive gear; and an electric stepper motor forming a part of said control assembly for rotating said nut member and causing axial movement of said quill shaft and said sleeve member.

8. The phase changing device of claim 7, wherein the outer circumference of said nut member is formed with gear teeth which mesh with the gear teeth of a pinion driven by said stepper motor.

9. The phase changing device as set forth in claim 8, wherein said nut member is formed with said helical groove and said sleeve member has a plurality of spherical balls located in hemispherical cavities spaced along a helical path that matches the helical groove in said nut member.

10. The phase changing device of claim 7, wherein said sleeve member is restrained from rotating about its longitudinal center axis by a tongue and groove arrangement located between said sleeve member and the housing of said control assembly.

11. The phase changing device as set forth in claim 7, wherein said drive gear is secured to a hub member having a cylindrical section formed with internal straight splines which mesh with the straight splines of said quill shaft.

12. The phase changing device as set forth in claim 7, wherein said first portion of said quill shaft is connected to and rotatable relative to a radially inwardly extending flange integrally formed with said sleeve member.

13. A phase changing device for an internal combustion engine comprising a timing drive assembly located at one end of said engine and a control assembly located at the other end of said engine, said timing drive assembly having a drive gear adapted to be driven by the crankshaft of said engine, a hollow camshaft extending between said timing drive assembly and said control assembly, a quill shaft co-axially mounted within said hollow camshaft and having a first portion located at said other end and being connected to said hollow camshaft by a plurality of helical splines surrounding said first portion of said quill shaft, a hub member fixed with said drive gear, a second portion of said quill shaft located at said one end of said engine and being connected to said hub member by a plurality of straight splines, an axially movable sleeve member connected to and surrounding said first portion of said quill shaft located at said other end, said first portion of said quill shaft being integrally formed with said helical splines, said second portion of said quill shaft being formed with said straight splines, said first and second portions of said quill shaft being supported for rotary movement relative to said camshaft, and a nut member surrounding said sleeve member and being drivingly connected to said sleeve member through a plurality of circumferentially spaced non-recirculating balls encapsulated in one of said members and located in a helical groove formed in the other of said members so that, upon rotation of said nut member, said sleeve member and said quill shaft move axially relative to said camshaft and simultaneously through said helical splines and said straight splines to cause said camshaft to change its angular position with respect to said drive gear.

14. A phase changing device for an internal combustion engine comprising a timing drive assembly located at one end of said engine and a control assembly located at the other end of said engine, said timing drive assembly having a drive gear adapted to be driven by the crankshaft of said engine, a hollow camshaft extending between said timing drive assembly and said control assembly, a quill shaft co-axially mounted within said hollow camshaft and having a first portion located at said other end and being connected to said hollow camshaft by a plurality of helical splines surrounding said first portion of said quill shaft, a hub member fixed with said drive gear, a second portion of said quill shaft located at said one end of said engine and being connected to said hub member by a plurality of straight splines, an axially movable sleeve member connected to and surrounding said first portion of said quill shaft located at said other end, said first portion of said quill shaft extending through said sleeve member and being rotatable relative to said sleeve member and said camshaft as dictated by said helical splines, and a nut member surrounding said sleeve member and being drivingly connected to said sleeve member through a plurality of circumferentially spaced non-recirculating balls encapsulated in one of said members and located in a helical groove formed in the other of said members so that, upon rotation of said nut member, said sleeve member and said quill shaft move axially relative to said camshaft and simultaneously through said helical splines and said straight splines to cause said camshaft to change its angular position with respect to said drive gear.

* * * * *